US011225862B2

(12) United States Patent
Moberg et al.

(10) Patent No.: US 11,225,862 B2
(45) Date of Patent: Jan. 18, 2022

(54) VIRTUAL HOIST STOP FOR MOBILE DRILLING MACHINE

(71) Applicant: Caterpillar Global Mining Equipment LLC, Denison, TX (US)

(72) Inventors: Carl J. Moberg, Dunlap, IL (US); Stephen M. Hancock, Van Alstyne, TX (US)

(73) Assignee: Caterpillar Gobal Mining Equipment LLC, Denison, TX (US)

( * ) Notice: Subject to any disclaimer, the term of this patent is extended or adjusted under 35 U.S.C. 154(b) by 0 days.

(21) Appl. No.: 16/773,364

(22) Filed: Jan. 27, 2020

(65) Prior Publication Data

US 2021/0230994 A1 Jul. 29, 2021

(51) Int. Cl.

| | |
|---|---|
| ***E21B 44/02*** | (2006.01) |
| ***E21B 7/02*** | (2006.01) |
| ***E21B 19/16*** | (2006.01) |
| *E21B 23/14* | (2006.01) |
| *E21B 47/04* | (2012.01) |

(52) U.S. Cl.

CPC ..... *E21B 44/02* (2013.01); *E21B 7/022* (2013.01); *E21B 19/165* (2013.01); *E21B 23/14* (2013.01); *E21B 47/04* (2013.01)

(58) Field of Classification Search

CPC ..... E21B 44/02; E21B 7/022; E21B 19/165; E21B 23/14; E21B 47/04

See application file for complete search history.

(56) References Cited

U.S. PATENT DOCUMENTS

| | | | | |
|---|---|---|---|---|
| 4,258,796 | A | 3/1981 | Horning et al. | |
| 4,334,217 | A * | 6/1982 | Nield | G01B 7/042 175/45 |
| 4,449,592 | A * | 5/1984 | Mayer | E21B 19/20 173/164 |
| 5,342,020 | A * | 8/1994 | Stone | B66D 1/485 254/269 |
| 6,298,927 | B1 | 10/2001 | Back | |
| 10,151,155 | B2 | 12/2018 | Jones et al. | |
| 10,392,878 | B2 | 8/2019 | Hudson et al. | |
| 2004/0162658 | A1* | 8/2004 | Newman | B66C 13/50 701/50 |
| 2011/0232971 | A1 | 9/2011 | Harmon | |
| 2014/0338973 | A1 | 11/2014 | Taylor et al. | |
| 2014/0338975 | A1* | 11/2014 | Hoult | E21B 47/024 175/40 |
| 2014/0343754 | A1* | 11/2014 | Poettker | G05D 1/0016 701/2 |
| 2017/0211342 | A1* | 7/2017 | Jones | E21B 19/146 |
| 2018/0016899 | A1 | 1/2018 | Galler et al. | |

* cited by examiner

*Primary Examiner* — Taras P Bemko

(74) *Attorney, Agent, or Firm* — von Briesen & Roper, s.c.

(57) ABSTRACT

A virtual hoist stop system for a mobile drilling machine may include a sensor assembly configured to monitor a full/empty status of a plurality of pipe storage slots, a drill string status, and a height of a rotary head, an operator interface configured to receive hoisting input, and a control module. The control module may be configured to receive signals from the sensor assembly, determine a target height based on the signals, receive hoisting input from the operator interface, and automatically stop the rotary head from hoisting beyond the target height.

17 Claims, 10 Drawing Sheets

VIRTUAL HOIST STOP FOR MOBILE DRILLING MACHINE

TECHNICAL FIELD

The present disclosure relates generally to mobile drilling machines and more specifically to systems and methods for raising and lowering in such drilling machines.

BACKGROUND

Mobile drilling machines, such as blasthole drilling machines, are typically used for drilling blastholes for mining, quarrying, dam construction, and road construction, among other uses. The process of excavating rock, or other material, by blasthole drilling comprises using the blasthole drill machine to drill a plurality of holes into the rock and filling the holes with explosives. The explosives are detonated causing the rock to collapse. The rubble of the collapse is then removed and the new surface that is formed is reinforced. Many current blasthole drilling machines utilize rotary drill rigs, mounted on a mast, that can drill blastholes anywhere from 6 inches to 22 inches in diameter and depths up to 180 feet or more.

In order to drill to deeper depths, it is often necessary to add additional pipe segments to extend the drill string. When doing so, a rotary head of the drill is disconnected from the lower pipe segments and raised to allow a new pipe segment to be rotated into line with the string. A similar process is used when removing pipe segments when a hole is complete. When the rotary head is raised manually, there is a risk of raising the rotary head higher than necessary. The additional height costs time. In many drilling applications, any wasted time can result in considerable financial costs.

The prior art has failed to adequately address this issue. Some machines, such as that disclosed by U.S. Publication No. 2014/0338973 to Taylor et al. minimize the risk of raising the rotary head higher than necessary by fully automating the process of adding or removing pipe segments. However, automation is expensive, and many applications do not require full automation. Therefore, a system is needed which provides an assist to the manual process without the high cost of an automatic system.

SUMMARY OF THE DISCLOSURE

According to one aspect of the present disclosure, a virtual hoist stop system for a mobile drilling machine is disclosed. The virtual hoist stop system includes a sensor assembly configured to monitor a full/empty status of a plurality of pipe storage slots, a drill string status, and a height of a rotary head; an operator interface configured to receive hoisting input; and a control module configured to receive signals from the sensor assembly, determine a target height based on the signals, receive hoisting input from the operator interface, and automatically stop the rotary head from hoisting beyond the target height.

According to another aspect of the present disclosures, a mobile drilling machine is disclosed. The drilling machine includes a frame; a mast mounted on the frame; a rotary head movably mounted on the mast; a drill string coupled to the rotary head and aligned within the mast; a plurality of pipe storage slots mounted on the mast, and a virtual hoist stop system. The virtual hoist stop system includes a sensor assembly configured to monitor a full/empty status of a plurality of pipe storage slots, a drill string status, and a height of a rotary head; an operator interface configured to receive hoisting input; and a control module configured to receive signals from the sensor assembly, determine a target height based on the signals, receive hoisting input from the operator interface, and automatically stop the rotary head from hoisting beyond the target height.

According to yet another aspect of the present disclosure, a method of providing a virtual hoist stop is disclosed. The method includes receiving signals from a sensor assembly, the signals including a full/empty status of a plurality of pipe storage slots, a drill string status, and a height of a rotary head; determining a target height based on the signals, receiving hoisting input from an operator interface, and automatically stopping the rotary head from hoisting beyond the target height.

These and other aspects and features of the present disclosure will be more readily understood after reading the following detailed description in conjunction with the accompanying drawings.

DETAILED DESCRIPTION

Figure 1:
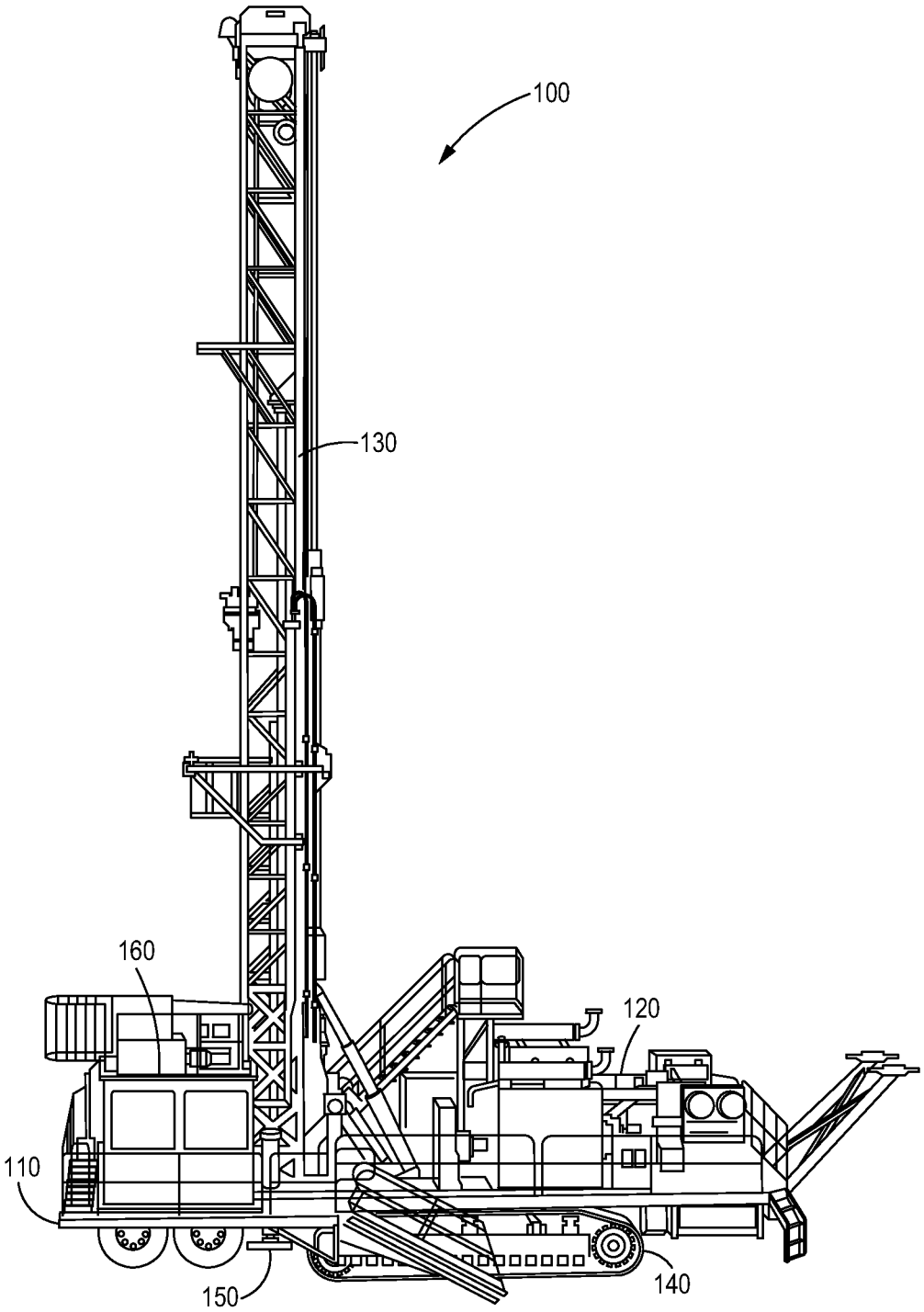
FIG. 1 is a side view of one embodiment of a drilling machine according to one embodiment of the present disclosure.

Referring now to the drawings, and with specific reference to FIG. 1, an exemplary drilling machine according to the present disclosure is referred to by reference numeral 100. Specifically, FIG. 1 depicts a rotary blasthole drilling machine. As shown in FIG. 1, the rotary blasthole drilling machine 100 includes a frame 110, an engine 120, and a drilling mast 130. The frame 110 is supported on a ground surface by a transport mechanism 140, such as crawler tracks. The transport mechanism 140 allows the drilling machine 100 to maneuver across a ground surface to a desired location for a drilling operation. The frame 110 may further include one or more jacks 150 for supporting and leveling the machine 100 on the ground surface during the drilling operation. The frame 110 also supports machinery such as motors, batteries, pumps, air compressors, hydraulic fluid storage and any other equipment necessary to power and operate the drilling machine 100 and not specifically numbered. The frame 110 also supports an operator cab 160 from which a user or operator may maneuver and control the drilling machine 100 via operator interfaces and displays not shown.

Figure 2:
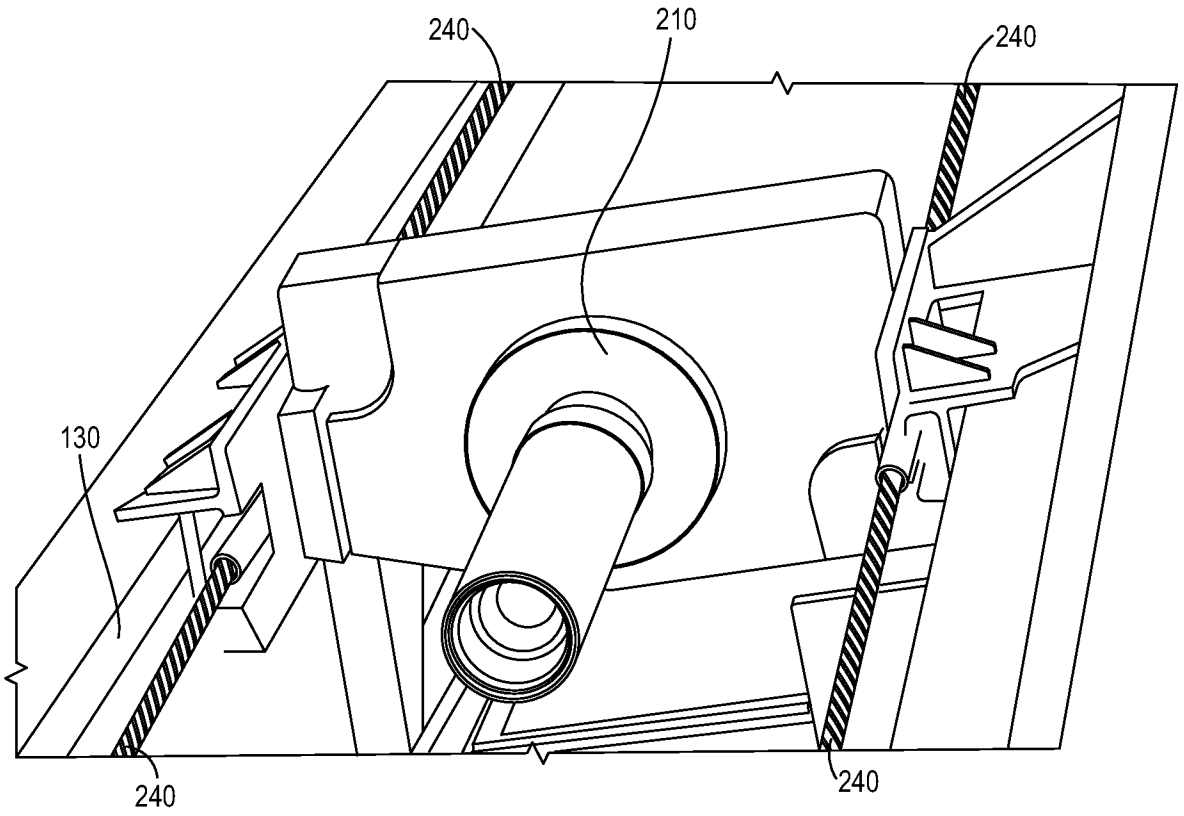
FIG. 2 is a perspective view of a rotary head and a portion of mast frame of the drilling machine of FIG.

FIG. 2 depicts a portion of the drilling mast. The drilling mast 130 supports a rotary head 210. The rotary head 210 is movably mounted on the mast 130 and couples to an upper end of a drill string 220 (shown in FIG. 3). A lower end of the drill string 220 connects to a drill bit (not shown) or other drill tool. During operation of the drilling machine 100, the rotary head 210 rotates the drill string 220, thereby rotating the drill bit in order to create a hole of the desired size and depth. Hydraulics or similar means may be used to rotate the rotary head 210. The rotary head 210 is hoisted and lowered along the mast 130 by a cable system 240 connected to a hydraulic cylinder (not shown). Controlling the extension of the hydraulic cylinder controls the height of the rotary head 210. An operator can direct the hoisting and lowering of the rotary head 210 from the operator cab 160 through a joystick or other similar means.

Figure 3:
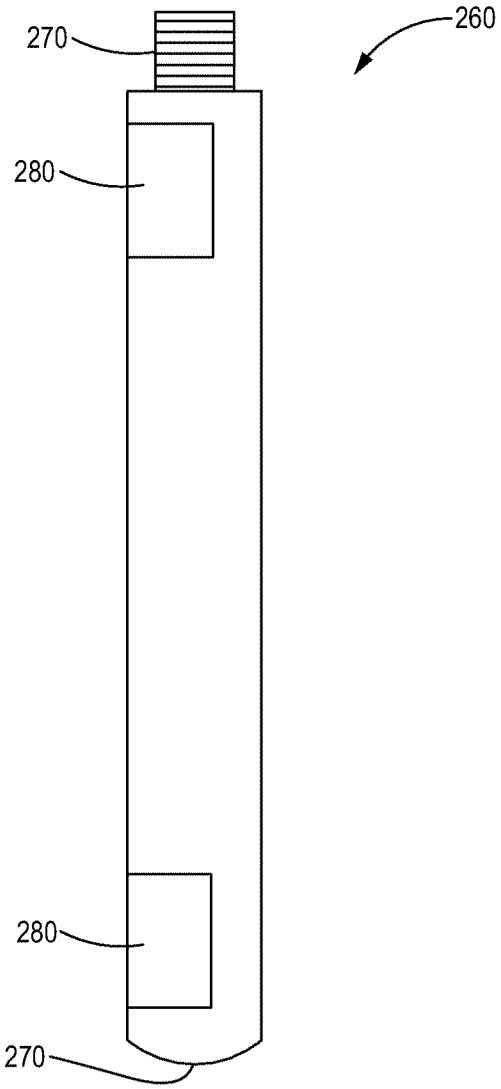
FIG. 3 is a side view of a lower portion of the mast of the drilling machine of FIG. 1 depicting a deck wrench and pipe loading assembly.

Furthermore, in order to allow the drill string 220 to extend or shorten, the drill string 220 may be made up of a plurality of pipe segments 260. An exemplary pipe segment is depicted in FIG. 3. Each pipe segment 260 has a threaded coupling at each end. In one embodiment, the threaded coupling 270 at a top end of each pipe segment 260 may be a male threading and the threaded coupling at a lower end of each pipe segment 260 may be a female threading. The pipe segments 260 also have a slightly recessed flattened section 280 proximate to the threaded coupling 270 at both ends. This flattened section 280 allows for the pipe segment 260 to be securely held such that rotation is prevented and vertical movement is restricted.

Figure 4:
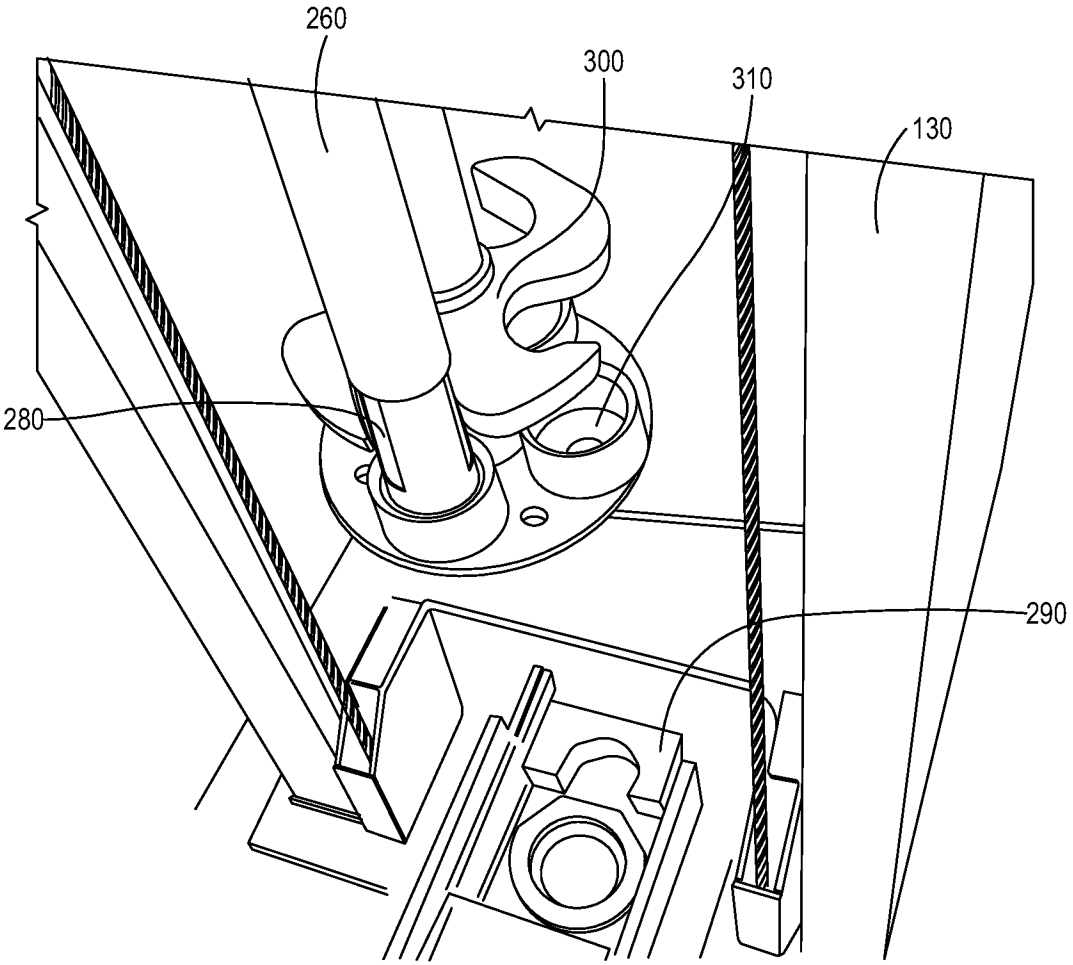
FIG. 4 is a perspective view of a pipe segment according to one embodiment of the present disclosure.

FIG. 4 depicts a lower portion of the mast 130 of the drilling machine 100 of FIG. 1 including a deck wrench 290 and a pipe loading assembly 300. The deck wrench 290 is located at the bottom of the mast 130 and is configured to fit around a pipe at the flattened section 280 to prevent rotation. The deck wrench 290 moves into line with the drill string 220 and prevents rotation in order to allow the rotary head 210 or pipe segments 260 to be unscrewed from lower portions of the drill string 220. The deck wrench 290 also holds the lower portion of the drill string preventing it from dropping vertically. A ridge created by the top of the flattened section 280 sits on top of the deck wrench 290.

Additional pipe segments 260 are used for extending the drill string 220 to allow a deeper hole to be drilling. These additional pipe segments 260 are each stored in a pipe storage slot 310 in at least one pipe loader assembly 300. The pipe loader assemblies 300 are located on the mast 130 adjacent to the rotary head 210 and aligned with the drill string 220. The pipe loader assemblies 300 are configured to move a pipe segment 260 in line with the rotary head 210 and drill string 220. The pipe loader assemblies 300 can also take a removed pipe segment 260 from the drill string 220 and move it into a pipe storage slot 310. To aid in moving pipe segments 260 and connecting them to the drill string 220, the pipe loader assemblies 310 are configured to hold pipe segments 260 securely at the flattened section 280 and prevent rotation. In some embodiments, there may be multiple pipe loader assemblies 300 located at different heights up the mast 130. Moreover, each pipe loader assembly 300 has at least one pipe storage slot 310. However, in some embodiments, a pipe loader assembly 300 may have additional pipe storage slots 300 in a rotating pipe carousel. This embodiment is depicted in FIG. 3.

Figure 6:
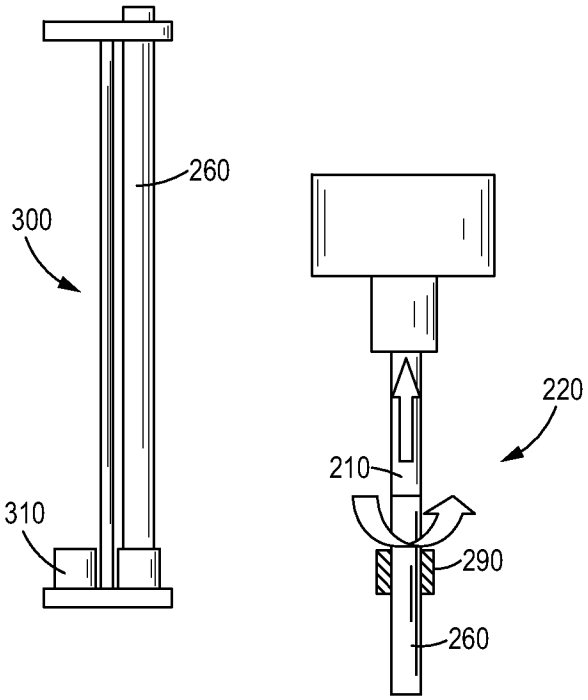
FIG. 6 is a schematic image of a drill string and pipe loader assembly of FIG. 1 in a second stage of the pipe addition process, according to the present disclosure.
Figure 5:
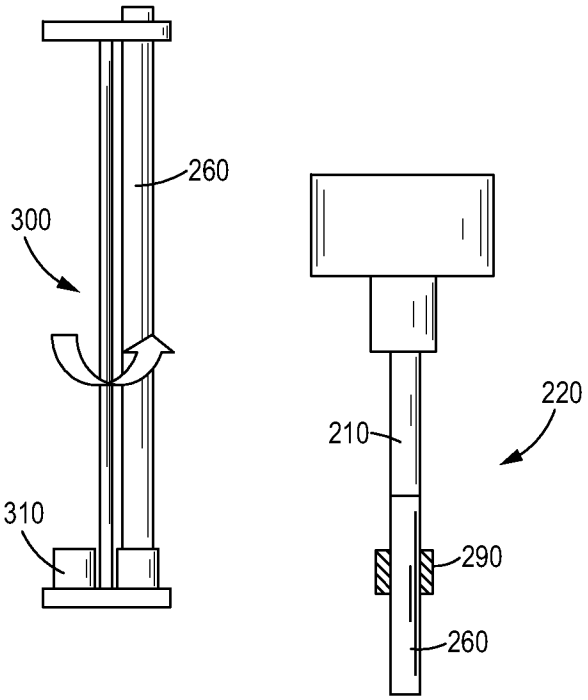
FIG. 5 is a schematic image of a drill string and pipe loader assembly of FIG. 1 in a first stage of the pipe addition process, according to the present disclosure.
Figure 8:
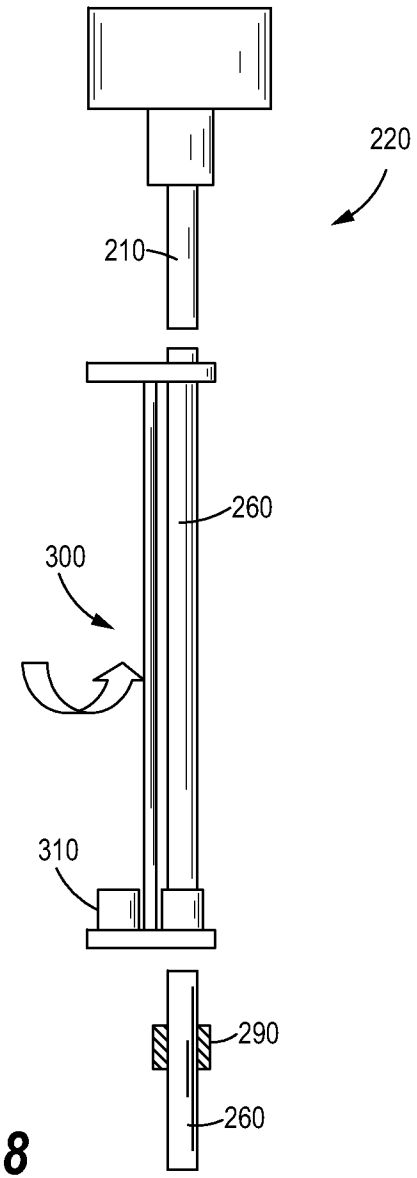
FIG. 8 is a schematic image of a drill string and pipe loader assembly of FIG. 1 in a fourth stage of the pipe addition process, according to the present disclosure.
Figure 7:
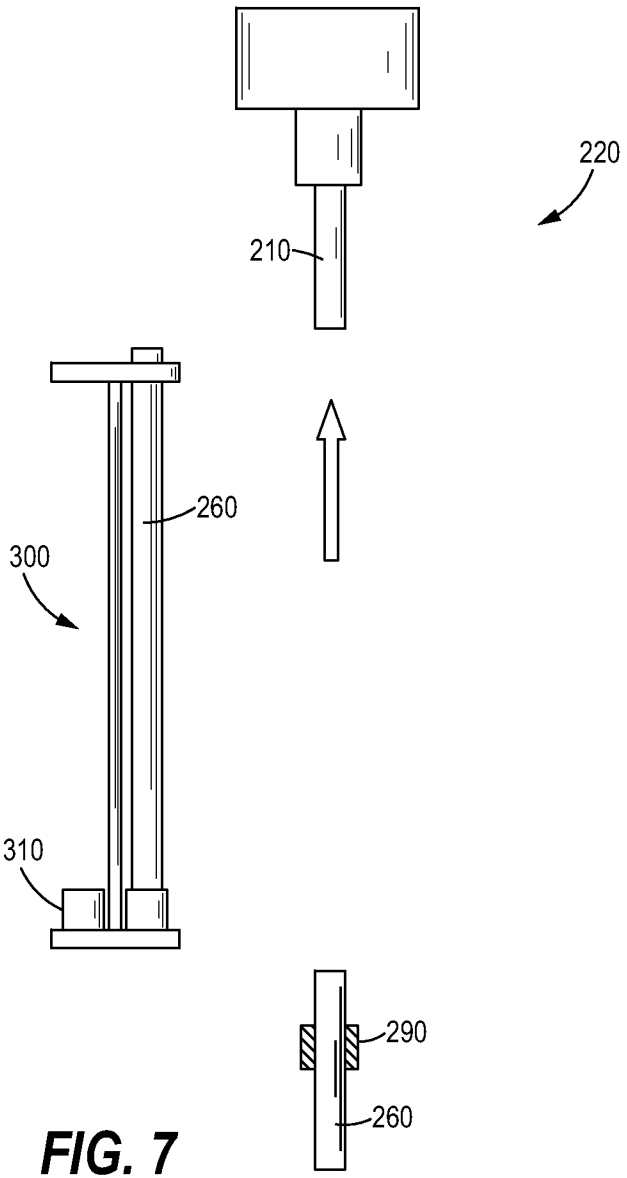
FIG. 7 is a schematic image of a drill string and pipe loader assembly of FIG. 1 in a third stage of the pipe addition process, according to the present disclosure.
Figure 10:
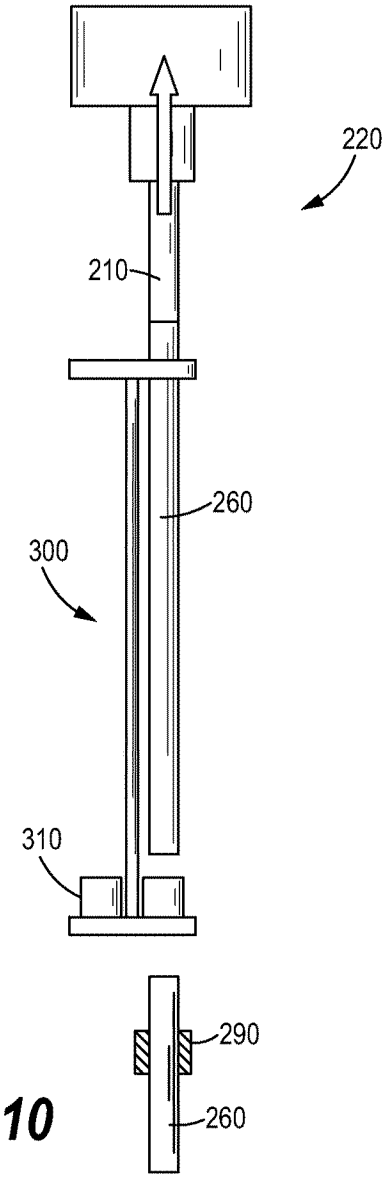
FIG. 10 is a schematic image of a drill string and pipe loader assembly of FIG. 1 in a sixth stage of the pipe addition process, according to the present disclosure.
Figure 9:
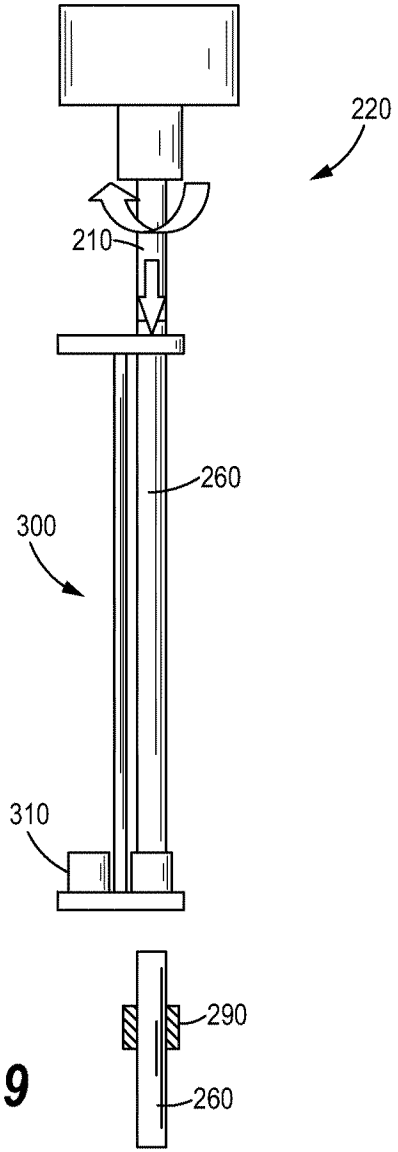
FIG. 9 is a schematic image of a drill string and pipe loader assembly of FIG. 1 in a fifth stage of the pipe addition process, according to the present disclosure.
Figure 12:
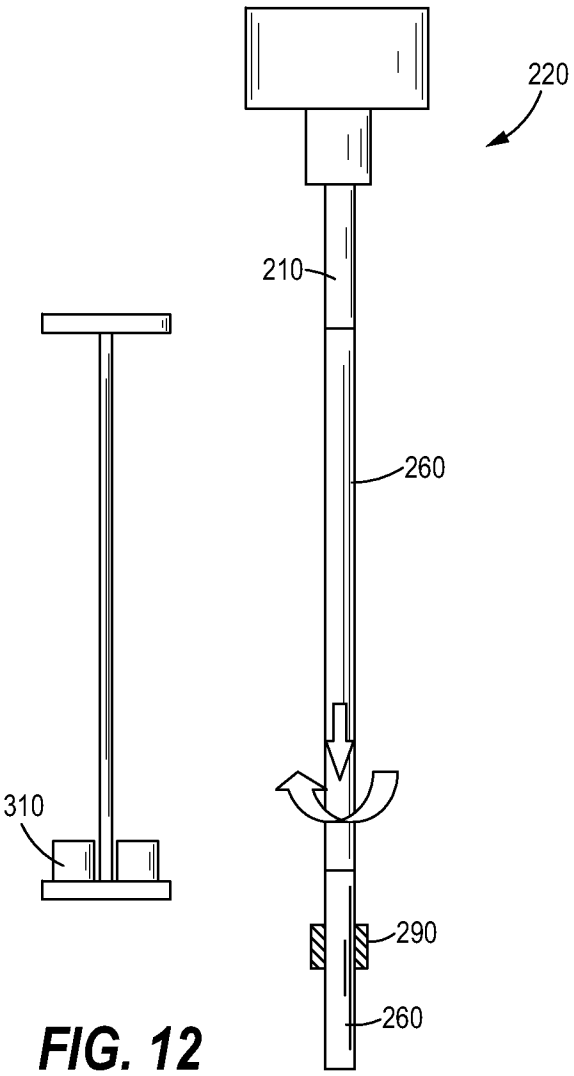
FIG. 12 a schematic image of a drill string and pipe loader assembly of FIG. 1 in an eighth stage of the pipe addition process, according to the present disclosure.
Figure 11:
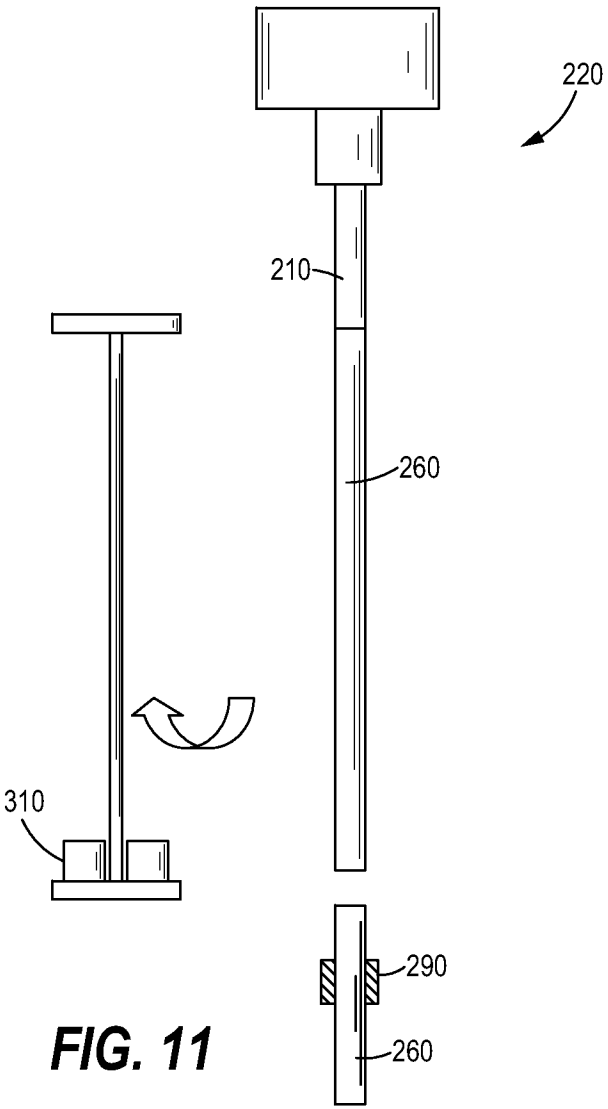
FIG. 11 is a schematic image of a drill string and pipe loader assembly of FIG. 1 in a seventh stage of the pipe addition process, according to the present disclosure.

FIGS. 5-12 depict the sequence of steps taken when an additional pipe segment 260 is added to the drill string 220. This operation takes place when the drill string 220 cannot reach to a desired hole depth. First, as shown in FIG. 5, the deck wrench 290 holds a top pipe segment 260 securely at the flattened section 280. If necessary, a pipe loader assembly 300 will rotate to provide a pipe segment 260. FIG. 6 depicts the separation of the rotary head 210 and pipe segment 260. This separation is achieved by rotating the rotary head 210 while the pipe segment is held in place by the deck wrench. The rotary head 210 moves upward as it unthread and decouples from the drill string 220. Next, the rotary head 210 is hoisted up the mast 130 to a position above a pipe loader assembly 300 with a full pipe slot, as shown in FIG. 7. FIG. 8 shows the pipe loader assembly 300 moving the pipe segment 260 into line with the rotary head 210 and drill string 220. In the illustrated embodiment, the pipe loader assembly rotates into position. Fla 9 depicts the rotary head 210 moving down and rotating to securely screw into the pipe segment 260. The pipe loader assembly 300 prevents the pipe segment 260 from rotating during this step by holding it at the flattened section 280. This allows a secure connection. In some embodiments, sensors in the rotary head may monitor torque to prevent over-tightening. The rotary head 210 and attached pipe segment 260 are lifted upwards slightly (FIG. 10) lifting the pipe segment from the pipe storage slot 310. This provides space for the pipe loader assembly 300 to move back out of the drill string (FIG. 11). Finally, as shown in FIG. 12, the rotary head 210 and pipe segment 260 are moved downwards and rotated in order to couple with the lower portions of the drill string 220. The deck wrench holds the lower portion of the drill string from rotating, creating a secure connection.

A very similar process is used in order to remove a pipe segment 260 when drilling is complete. The rotary head 210 and top pipe segment 260 are separated from the remainder of the pipe string and hoisted to a pipe loader assembly 300 with an empty pipe storage slot 310. The pipe segment 260 is moved into the empty pipe storage slot 310 and then disconnected from the rotary head 210. The rotary head 210 is then lowered and connected to the next pipe segment 260 of the drill string 220.

During the hoisting step, it is important that the rotary head 210 is not hoisted higher than necessary. Hoisting the rotary head 210 too high wastes time and therefore money. The ideal height is the minimum height above a pipe loader assembly 300 which allows for a pipe segment 260 to be added or removed. In order to prevent over-hoisting, the drilling machine 100 includes a virtual hoist stop system 400 which stops the rotary head 210 at the target height.

Figure 13:
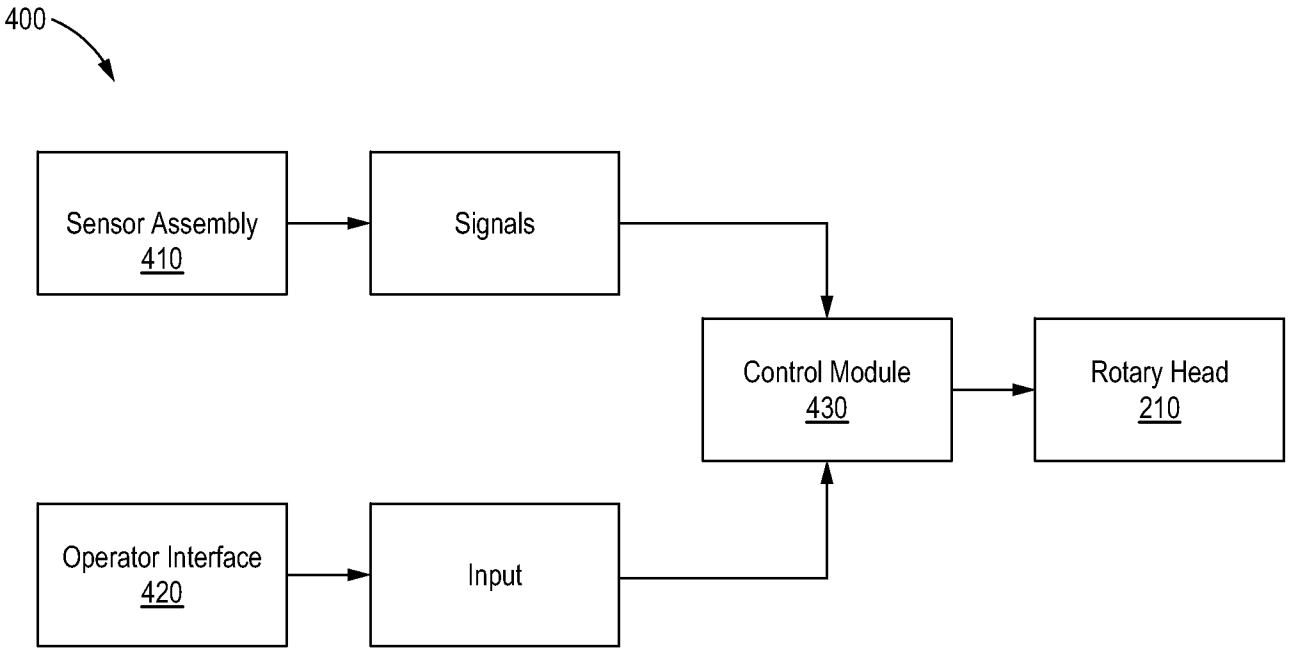
FIG. 13 is a schematic representation of a virtual hoist stop system according to the present disclosure.

As depicted in FIG. 13, the virtual hoist stop system 400 includes a sensor assembly 410, an operator interface 420, and a control module 430. The sensor assembly 410 is configured to monitor the height of the rotary head 210, a full/empty status for each pipe storage slot 310, and a drill string 220 status. The full/empty status for each pipe storage slot 310 indicates whether that slot contains a pipe segment 260. The drill string 220 status indicates whether a pipe segment 260 is being added or removed, based on whether the drill string 220 is separated at the rotary head 210 or below the first pipe segment 260.

The operator interface 420 is configured to receive hoisting input from an operator to raise the rotary head 210.

The control module 430 is configured to receive signals from the sensor assembly and input from the operator interface. The control module is further configured to take the signals and input and determine a target height based on the drill string 220 status and the status of the plurality of pipe storage slots 310. If the drill string 220 status indicates that a pipe segment 260 is being added, the target height is determined to be the minimum height above the lowest pipe loader assembly 300 with a full pipe storage slot 310. If the drill string 220 status indicates that a pipe segment 260 is being removed, the target height is determined to be the minimum height above the lowest pipe loader assembly 300 with an empty pipe storage slot 310.

The control module may farther be configured to proportionally limit the hoisting input as the rotary head approaches the target height. As the rotary head gets near the target height, the control module will limit the actual hoisting of the rotary head to a percentage of the hoisting input from 100% to 0% above the target height, where 100% is the complete hoisting input and 0% is a full stop. In one embodiment, the proportional limit may transition from 100% at 500 min below the target height to 5% at 5 mm below the target height and further to 0% above the target height. Of course, other transitional patterns may be used as appropriate based on the specific masses and inertias as necessary to minimize overshoot.

The virtual hoist stop 400 may be over ridden by stopping hoisting input and then resuming. This allows the rotary head 210 to be hoisted beyond the target height if required.

INDUSTRIAL APPLICABILITY

During the hoisting step, it is important that the rotary head 210 is not hoisted higher than necessary. Hoisting the rotary head 210 too high wastes time and therefore money. The ideal height is the minimum height above a pipe loader assembly 300 which allows for a pipe segment 260 to be added or removed. The virtual hoist stop system 400 of the present disclosure prevents such over-hoisting and thus saves time and money.

The virtual hoist stop system 400 may be used in any application in which objects are manually hoisted by operator input but also require that the object be stopped at a precise location. In particular, the system may be applicable to drilling machine 100*s*, cranes, and elevators.

Figure 14:
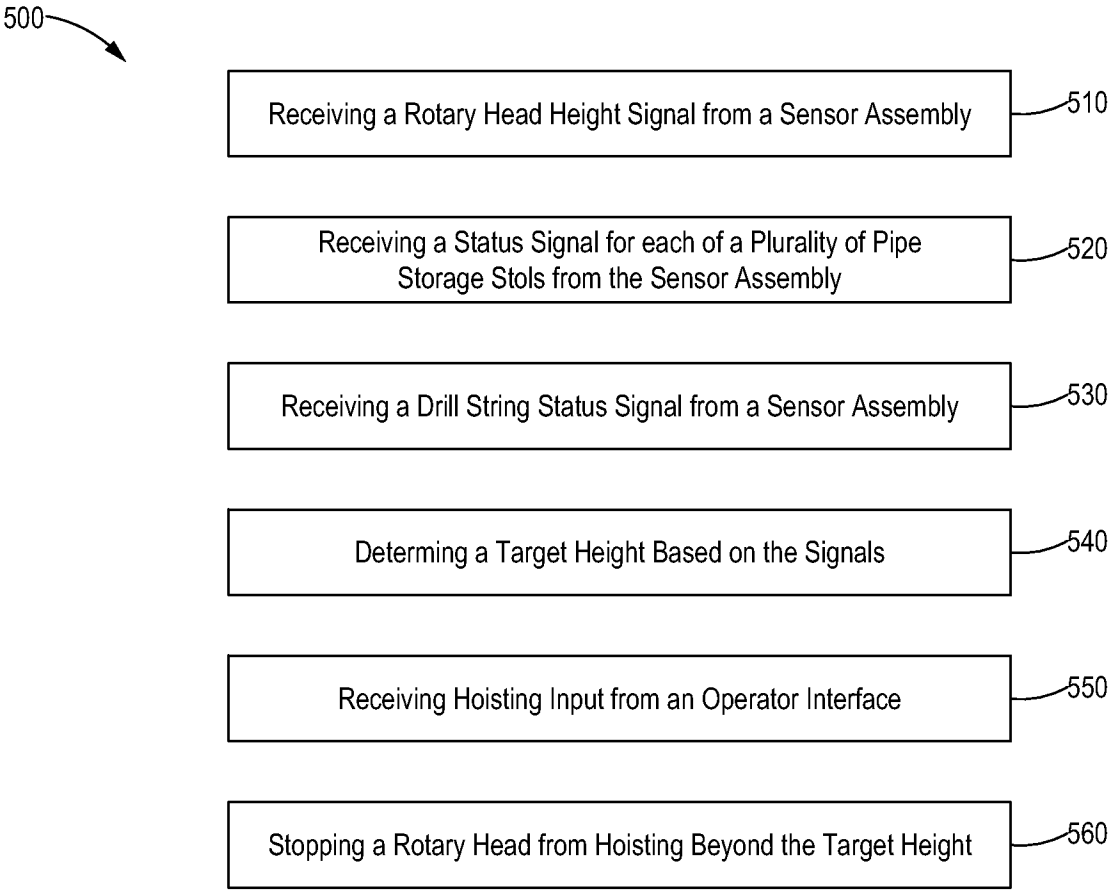
FIG. 14 is a flowchart representation of a method of providing a virtual hoist stop system according to the present disclosure.

The system uses the following method 500, as depicted in FIG. 14. As shown in blocks 510-530, the first steps involve receiving signals from a sensor assembly 410. The signals include a height of the rotary head (block 510), a status for each of a plurality of pipe storage slots (block 520), and a drill string status (block 530). The status for each of the plurality of pipe storage slots 310 indicates whether that slot contains a pipe segment 260. The drill string 220 status indicates whether a pipe segment 260 is being added or removed, based on whether the drill string 220 is separated at the rotary head 210 or below the first pipe segment 260.

A next step, shown in block 540, is determining a target height based on the signals. If the drill string 220 status indicates that a pipe segment 260 is being added, the target height is determined to be the minimum height above the lowest pipe loader assembly 300 with a fall pipe storage slot 310. If the drill string 220 status indicates that a pipe segment 260 is being removed, the target height is determined to be the minimum height above the lowest pipe loader assembly 300 with an empty pipe storage slot 310.

Next, the system receives hoisting input from an operator interface (block 550). Finally, the method is concluded by stopping a rotary head from hoisting beyond the target height (block 560). In some embodiments, the virtual hoist stop may be overridden by stopping and then resuming hoisting input. In that case, the rotary head may hoist above the target height.

In some embodiments, the method may also include proportionally limiting the hoisting input as the rotary head approaches the target height. As the rotary head gets near the target height, the actual hoisting of the rotary head will be limited to a percentage of the hoisting input from 100% to 0% above the target height where is the complete hoisting input and 0% is a full stop. In one embodiment, the proportional limit may transition from 100% at 500 mm below the target height to 5% at 5 mm below the target height and further to 0% above the target height. Of course, other transitional patterns may be used as appropriate based on the specific masses and inertias as necessary to minimize overshoot.

While the preceding text sets forth a detailed description of numerous different embodiments, is should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. A virtual hoist stop system for a mobile drilling machine, comprising:

a sensor assembly configured to monitor a status of a plurality of pipe storage slots of pipe loader assemblies, a drill string status, and a height of a rotary head, wherein the drill string status indicates whether a pipe segment is being added or removed;

an operator interface configured to receive hoisting input; and a control module configured to:

receive signals from the sensor assembly, determine a target height for the rotary head based on the signals including the drill string status indication of whether the pipe segment is being added or removed, receive hoisting input from an operator of the mobile drilling machine at the operator interface to manually control movement of the rotary head through the operator interface, cause the rotary head to move relative to the pipe loader assemblies in response to the hoisting input at the operator interface, and automatically stop the rotary head from hoisting beyond the target height when the rotary head moves in response to the hoisting input at the operator interface.

2. The virtual hoist stop system of claim 1, wherein stopping and then resuming hoisting input will override the virtual hoist stop system and allow the rotary head to be hoisted above the target height.

3. The virtual hoist stop system of claim 1, wherein the status of each of the plurality of pipe storage slots is monitored by a pipe detect switch.

4. The virtual hoist stop system of claim 1, wherein the control module is further configured to proportionally limit the hoisting input as the rotary head approaches the target height.

5. A virtual hoist stop system for a mobile drilling machine, comprising:

a sensor assembly configured to monitor a status of a plurality of pipe storage slots, a drill string status, and a height of a rotary head, wherein the drill string status indicates whether a pipe segment is being added or removed;

an operator interface configured to receive hoisting input; and a control module configured to:

receive signals from the sensor assembly, determine a target height for the rotary head based on the signals including the drill string status indication of whether the pipe segment is being added or removed, wherein the target height is a minimum height above the lowest of the plurality of pipe storage slots which allows for adding and removing the pipe segment, receive hoisting input from the operator interface, and automatically stop the rotary head from hoisting beyond the target height.

6. A virtual hoist stop system for a mobile drilling machine, comprising:

a sensor assembly configured to monitor a status of a plurality of pipe storage slots, a drill string status, and a height of a rotary head, wherein the drill string status indicates whether a pipe segment is being added or removed;

an operator interface configured to receive hoisting input; and a control module configured to:

receive signals from the sensor assembly, determine a target height for the rotary head based on the signals including the drill string status indication of whether the pipe segment is being added or removed, wherein the target height is determined to be a clearance height above the lowest full pipe storage slot if the pipe segment is being added, and the target height is determined to be a clearance height above the lowest empty pipe storage slot if the pipe segment is being removed, receive hoisting input from the operator interface, and automatically stop the rotary head from hoisting beyond the target height.

7. A mobile drilling machine, comprising:

a frame;

a mast mounted on the frame;

a rotary head movably mounted on the mast;

a drill string coupled to the rotary head and aligned within the mast;

a plurality of pipe storage slots of pipe loader assemblies mounted on the mast;

a sensor assembly configured to monitor a status of the plurality of pipe storage slots, a drill string status, and a height of the rotary head, wherein the drill string status indicates whether a pipe segment is being added or removed;

an operator interface configured to receive hoisting input; and a control module configured to:

receive signals from the sensor assembly, determine a target height for the rotary head based on the signals including the drill string status indication of whether the pipe segment is being added or removed, receive hoisting input from an operator of the mobile drilling machine at the operator interface to manually control movement of the rotary head through the operator interface, cause the rotary head to move relative to the pipe loader assemblies in response to the hoisting input at the operator interface, and automatically stop the rotary head from hoisting beyond the target height when the rotary head moves in response to the hoisting input at the operator interface.

8. The mobile drilling machine of claim 7, wherein the target height is a minimum height above the lowest of the plurality of pipe storage slots which allows for adding and removing the pipe segment.

9. The mobile drilling machine of claim 7, wherein stopping and then resuming hoisting input will override the virtual hoist stop system and allow the rotary head to be hoisted above the target height.

10. The mobile drilling machine of claim 7, wherein the status of each of the plurality of pipe storage slots is monitored by a pipe detect switch.

11. The mobile drilling machine of claim 7, wherein the control module is further configured to proportionally limit the hoisting input as the rotary head approaches the target height.

12. The mobile drilling machine of claim 7, wherein the target height is determined to be a clearance height above the lowest full pipe storage slot if the pipe segment is being added, and the target height is determined to be a clearance height above the lowest empty pipe storage slot if the pipe segment is being removed.

13. A method for providing a virtual hoist stop for a mobile drilling machine, comprising:

receiving signals from a sensor assembly, the signals including a status of a plurality of pipe storage slots of pipe loader assemblies, a drill string status, and a height of a rotary head, wherein the drill string status indicates whether a pipe segment is being added or removed;

determining a target height for the rotary head based on the signals including the drill string status indication of whether the pipe segment is being added or removed;

receiving hoisting input from an operator of the mobile drilling machine at an operator interface to manually control movement of the rotary head through the operator interface;

causing the rotary head to move relative to the pipe loader assemblies in response to the hoisting input at the operator interface; and automatically stopping the rotary head from hoisting beyond the target height when the rotary head moves in response to the hoisting input at the operator interface.

14. The method of claim 13, wherein the target height is a minimum height above the lowest of the plurality of pipe storage slots which allows for adding and removing the pipe segment.

15. The method of claim 13, wherein stopping and then resuming hoisting input will override the virtual hoist stop system and allow the rotary head to be hoisted above the target height.

16. The method of claim 13, wherein the status of each of the plurality of pipe storage slots is monitored by a pipe detect switch.

17. The method of claim 13, wherein the target height is determined to be a clearance height above the lowest full pipe storage slot if the pipe segment is being added, and the target height is determined to be a clearance height above the lowest empty pipe storage slot if the pipe segment is being removed.

* * * * *